US005383550A

United States Patent [19]

Tsao

[11] Patent Number: 5,383,550

[45] Date of Patent: Jan. 24, 1995

[54] CONTACT LENS CASE

[75] Inventor: Fu-Pao Tsao, Lawrenceville, Ga.

[73] Assignee: Ciba-Geigy Corporation, Ardsley, N.Y.

[21] Appl. No.: 168,727

[22] Filed: Dec. 16, 1993

Related U.S. Application Data

[63] Continuation of Ser. No. 988,072, Dec. 9, 1992, abandoned.

[51] Int. Cl.[6] ..... A45C 11/04

[52] U.S. Cl. ..... 206/5.1; 134/901; 206/205

[58] Field of Search ..... 206/5.1, 205, 207; 134/137, 901

[56] References Cited

U.S. PATENT DOCUMENTS

| | | | |
|---|---|---|---|
| 3,394,717 | 7/1968 | Hollinger | 206/5.1 |
| 3,460,552 | 8/1969 | Sturgeon | 206/5.1 |
| 3,661,248 | 5/1972 | Isen et al. | 206/5.1 |
| 3,695,280 | 10/1972 | Sturgeon | 206/5.1 |
| 3,856,571 | 12/1974 | Sherman | 134/34 |
| 3,880,278 | 4/1975 | Brown | 206/5.1 |
| 3,912,415 | 10/1975 | Maurice | 415/72 |
| 3,977,517 | 8/1976 | Kadlecik et al. | 206/5.1 |
| 3,990,579 | 11/1976 | Manning | 206/501 |
| 4,091,917 | 5/1978 | Clawson | 206/5.1 |
| 4,228,136 | 10/1980 | Thomas | 206/5.1 |
| 4,328,890 | 5/1982 | Thomas et al. | 206/5.1 |
| 4,337,858 | 7/1982 | Thomas | 206/5.1 |
| 4,392,569 | 7/1983 | Shoup | 206/205 |
| 4,406,362 | 9/1983 | Thomas | 206/5.1 |
| 4,758,595 | 7/1988 | Ogunbiyi et al. | 514/635 |
| 4,858,754 | 8/1989 | Wright et al. | 206/5.1 |
| 4,890,729 | 1/1990 | Ranalletta | 206/5.1 |
| 4,942,959 | 7/1990 | Sauber et al. | 206/5.1 |
| 5,181,604 | 1/1993 | Ohta et al. | 206/5.1 |

FOREIGN PATENT DOCUMENTS

| | | | |
|---|---|---|---|
| 2279636 | 2/1976 | France | G02C 7/04 |
| 2531827 | 2/1976 | Germany | 206/5.1 |
| 8320496 | 7/1983 | Germany | A45C 11/04 |

*Primary Examiner*—David T. Fidei

*Attorney, Agent, or Firm*—Edward McC. Roberts; R. Scott Meece

[57] ABSTRACT

A case for carrying and disinfecting contact lenses has a reservoir portion for holding a lens and solution, a plurality of projections extending from the reservoir floor upon which the lens may be positioned, and, a basket portion hingedly attached to the case and capable of being folded over the projections to hold the lens in place within the reservoir. A cap is provided for sealing the reservoir.

10 Claims, 2 Drawing Sheets

CONTACT LENS CASE

This application is a continuation of application Ser. No. 07/988,072, filed Dec. 9, 1992, now abandoned.

The present invention relates to the contact lens field, and more particularly to a contact lens carrying case which may also be used for disinfecting contact lenses.

The proper care and handling of contact lenses requires a number of accessory items. A case for carrying and/or storing lenses between wearing times is needed. To date these cases have consisted of a plastic body having a pair of wells, each of a size and shape adapted to receive a lens and an amount of saline or other storage solution. Each well is sealed by means of a screw cap, which is threadingly engageable to a threaded annular rim surrounding the well, or a simple snap-closure.

Another accessory used by contact lens wearers is means in which the lens is sterilized. Sterilization of lenses is mandatory prior to placement of the lens into the eye. To date, lenses have been sterilized in systems such as that described in U.S. Pat. No. 3,912,415 to Gaglia, which includes a cup for holding a hydrogen peroxide disinfectant solution, a cup closure, a basket for holding lenses in the cup and a catalyst for neutralizing the hydrogen peroxide. In some systems, the metal catalyst is replaced by a neutralizing solution which is placed into the cup. In these systems, the potential wearer must manually remove each lens from the storage/carrying case and place it into the disinfection system. After the disinfection process is completed, the lens may be rinsed with saline and placed into the eye. A problem exists, however, in that the wearer must repeatedly handle the lens before and during the carrying and disinfection processes, thereby increasing the chances of damaging or further contaminating the lens.

Another, more recent development has been the "one bottle disinfecting solution" system. In such a system, the user holds the lens in his hand and rubs while pouring a single disinfecting solution onto the lens. An example of such a solution may be found in U.S. Pat. No. 4,758,595 to Ogunbiyi et al. This system is problematic because it requires extensive handling the lenses. The handling may damage or add to the contamination of the lens.

Therefore, there exists a need for means of disinfecting a contact lens which minimizes the amount of handling of the lens. There also exists a need for such means which minimizes the number of accessories needed for carrying and disinfecting a contact lens.

SUMMARY OF THE INVENTION

The present invention relates to a contact lens case which may be used for disinfecting contact lenses in a one bottle solution process, as well as for carrying the lens. The case has a main body portion defining a reservoir capable of receiving a contact lens to be carried and sterilized and a sufficient amount of a disinfecting solution. Contact lens positioning means are provided within the reservoir, said means being configured to receive at least one contact lens and to suspend the lens within the reservoir. The contact lens holding means are porous thereby permitting circulation of the disinfecting solution therethrough. Preferrably, the holding means are in the form of a basket which is hingedly attached to the main body. Means for sealing the reservoir are also provided.

DETAILED DESCRIPTION OF THE INVENTION

The present invention relates to a contact lens case which may be used for carrying contact lenses, as well as for disinfecting contact lenses using a disinfecting solution.

Figure 1:
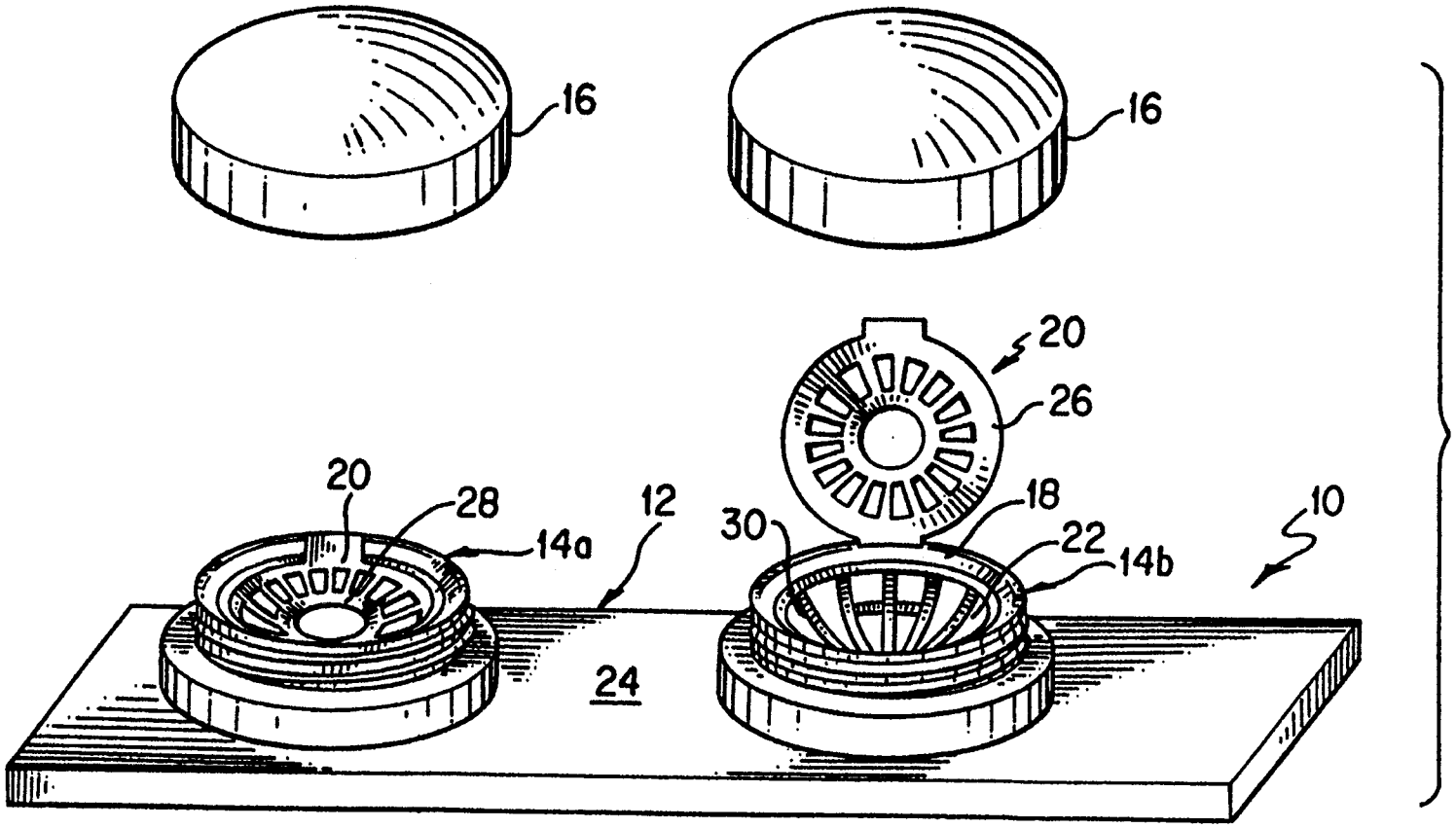
FIG. 1 is a perspective view of a contact lens case according to the present invention having one lens positioning means in raised position.
Figure 2:
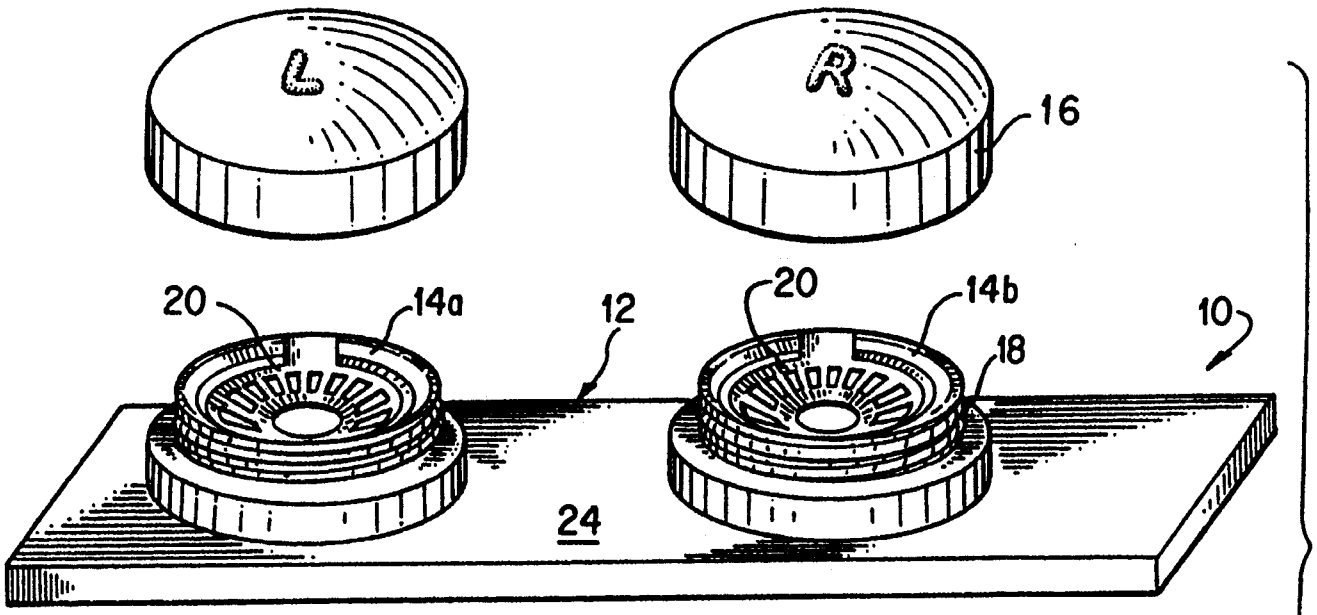
FIG. 2 is a perspective view of a contact lens case according to the present invention having both of its lens position means in lowered position.

In one embodiment of the invention, as shown in FIGS. 1 and 2, the case 10 has a main body portion 12. The case 10 may be constructed of a material which is sturdy and impervious to the disinfecting solution. Polystyrene is the construction material of choice, although others may be used.

The main body portion 12 defines at least one, but preferably two, reservoirs 14 capable of receiving one or more contact lenses. Each reservoir 14 has a floor portion 22. In the preferred embodiment, the main body portion 12 defines two separate and discrete reservoirs **14*a*, 14*b*, each of which is adapted to receive one contact lens. The reservoirs 14*a*, 14*b* should also be adapted to receive an amount of solution for disinfecting or storing the lens. The main body portion 12 may also include a platform 24 for maintaining the case 10** in stable position during the disinfecting process, such as on a table.

Means for sealing the reservoirs **14*a*, 14*b* are also provided to isolate the interior portion of each reservoir from the surrounding environment. This has the function of preventing the introduction into the solution of any additional microbes such as airborne microorganisms. It also serves to prevent spillage of solution from the container during handling. The sealing means may comprise a screw cap 16 capable of being threadingly attached to an annular rim 18 surrounding a reservoir 14. Alternatively, the sealing means may be a top adapted to snap-fit on the main body portion 12**. Other sealing means may also be employed.

Means for maintaining the contact lens in stable position within the reservoir 14 are provided. The contact lens positioning means should be porous to permit circulation of the disinfecting solution throughout the reservoir 14 and to the entire suface of the lens. For example, as shown in the Figures, the lens positioning means may be a mesh-like member, such as a basket 20 hingedly attached to the rim 18. The basket 20 has a convex bottom surface 26 which approximates the shape of the concave surface of a contact lens, as well as a concave upper surface 28.

Figure 3:
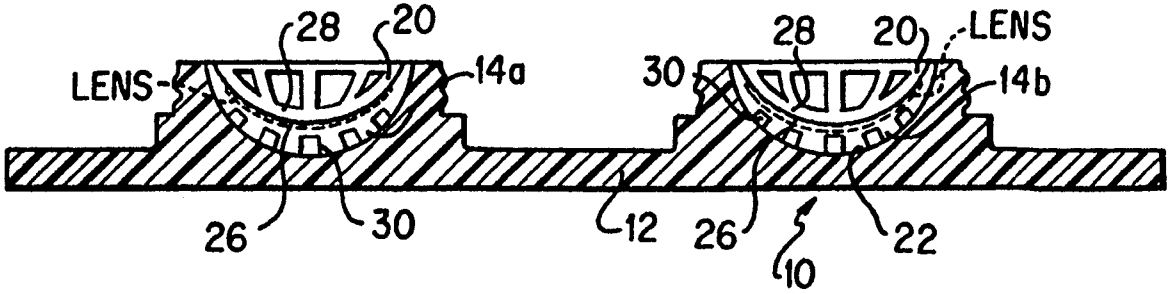
FIG. 3 is a crossectional view of a contact lens case according to the present invention.

Means for suspending a lens above the reservoir floor 22 are also provided. The means are preferrably a plurality of projections, such as the raised ribs 30 shown in FIG. 3, extending upwards towards the basket bottom surface 26. Sufficient space must be provided between the ribs 30 and the bottom surface 26 to allow for a contact lens to be held therebetween.

When the device of the present invention is used as a contact lens carrying case, the lenses are simply placed in the baskets 20 and covered with saline or some other storage solution. When needed, each lens can be easily slid out of its respective basket 20.

When the device of the present invention is used as a disinfecting case, each basket 14*a,b* is raised and a contact lens is placed unto each rib 30. Each basket 20 is then lowered, thereby confining a lens in the space between the basket bottom surface 26 and the rib 30. Disinfecting solution is then poured into each reservoir 14*a,b* and the caps 16 are then replaced onto the rims 18 to reseal the reservoirs 14*a,b*. The sealed case 10 may be shaken if so required by the disinfection solution used. In this way, both sides of the lens is contacted by the solution and antimicrobial activity is enhanced. Once the disinfection process is completed, the caps 16 are removed, the disinfecting solution dumped out of the reservoirs 14*a*. If necessary, a second solution, such as a neutralizing solution or a saline rinsing solution may be added to the reservoir, the caps 16 may be replaced and the case 10 again shaken to assure neutralization or rinsing. The caps 16 may then be removed, the baskets 20 may be raised to allow removal of the ready-to-wear lenses.

Therefore, the present invention provides a device for disinfecting contact lenses which minimizes the amount of handling of the lenses, yet assures that both surfaces of the lens contacts the disinfecting solution. Also, the same device may be used as a carrying case for the lenses, thereby eliminating the need for multiple accessories.

What is claimed is:

1. A contact lens case which may be used for both carrying and disinfecting a contact lens, comprising:

a) a main body portion defining a reservoir capable of receiving a contact lens and an amount of a disinfecting solution sufficient to disinfect said lens, the reservoir having a floor portion which is concave to correspond to the convex surface of a contact lens;

b) a plurality of ribs extending upwardly from the reservoir floor for suspending the contact lens in position above the floor of the reservoir;

c) a basket having a convex bottom surface corresponding to the concave surface of a contact lens, the basket capable of being placed within the reservoir at a position above the ribs to form a space for holding the contact lens and porous to allow solution to circulate throughout the reservoir; and d) means for sealing the reservoir, whereby a lens inserted into said reservoir is maintained with the concave side facing up while said is located in a resting position, thereby reducing trapped air bubbles and improving lens surface contact with solution contained in the reservoir.

2. The contact lens case of claim 1, wherein the contact lens said basket are hingedly attached to the main body.

3. The contact lens case of claim 1, wherein the main body portion defines two separate and discrete reservoirs each of which is adapted to receive one contact lens.

4. The contact lens case of claim 1, wherein the sealing means is a screw cap.

5. The contact lens case of claim 1, wherein the sealing means is a top adapted to snap-fit on the main body portion.

6. The contact lens case of claim 1, wherein the main body portion includes a platform for maintaining the case in stabile position during the disinfecting process.

7. The contact lens case of claim 3, wherein both reservoirs include a concave floor portion adapted to receive the convex surface of a contact lens, and wherein both of the reservoir concave floor portions face in the same direction.

8. A process of cleaning and/or disinfecting a contact lens, comprising the steps of:

(a) placing the contact lens, concave side facing substantially upward, into a concave receiving floor portion of a cleaning reservoir, the reservoir having suspending means which maintain the contact lens above the floor of the reservoir;

(b) placing a positioning means having a convex surface and a concave surface, with the concave surface facing upward, onto the contact lens;

(c) adding a disinfecting solution into the cleaning reservoir, thereby substantially covering the contact lens with the disinfecting solution; and (d) maintaining said lens in a concave up position during said cleaning and/or disinfection process, whereby the positioning of the contact lens concave side up and above the floor of the reservoir and the maintenance of the lens in concave up position substantially prevents inadequate cleaning resulting from bubble entrapment.

9. A process as recited in claim 8, further comprising the step of securing a sealing means onto the cleaning reservoir, thereby inhibiting leakage of solution from the reservoir upon inversion of the reservoir.

10. A process as recited in claim 8, whereby two contact lenses are cleaned substantially simultaneously, and wherein the concave surfaces of both contact lenses face substantially upwardly during the cleaning process.

* * * * *